US007460084B2

(12) United States Patent
Upton

(10) Patent No.: US 7,460,084 B2
(45) Date of Patent: Dec. 2, 2008

(54) RADIO FREQUENCY HOLOGRAPHIC TRANSFORMER

(75) Inventor: Eric L. Upton, Bellevue, WA (US)

(73) Assignee: Northrop Grumman Corporation, Los Angeles, CA (US)

( * ) Notice: Subject to any disclaimer, the term of this patent is extended or adjusted under 35 U.S.C. 154(b) by 404 days.

(21) Appl. No.: 11/255,607

(22) Filed: Oct. 19, 2005

(65) Prior Publication Data

US 2007/0103381 A1 May 10, 2007

(51) Int. Cl.
*H01Q 15/02* (2006.01)

(52) U.S. Cl. ..... 343/909

(58) Field of Classification Search ..... 343/753, 343/754, 909

See application file for complete search history.

(56) References Cited

U.S. PATENT DOCUMENTS

| | | | | |
|---|---|---|---|---|
| 3,434,138 | A | 3/1969 | Shostak | |
| 6,859,189 | B1 * | 2/2005 | Ramirez et al. | 343/815 |
| 2004/0160382 | A1 | 8/2004 | Rawnick et al. | |

FOREIGN PATENT DOCUMENTS

| | | |
|---|---|---|
| DE | 2 160 936 | 12/1971 |
| EP | 0 688 062 A2 | 12/1995 |
| GB | 2 234 118 A | 1/1991 |

OTHER PUBLICATIONS

Fathy A et al Institute of Electrical and Electronics Engineers: "*Silicon Based Reconfigurable Antennas*"; 2001 IEEE MTT-S International Microwave Symposium Digest. (IMS 2001). Phoenix, AZ, May 20-25, 2001, IEEE MTT-S International Microwave Symposium, New York, NY: IEEE, US, vol. 1 of 3, May 20, 2001, pp. 377-380, XP001067301 ISBN: 0-7803-6538-0, Abstract; Figs. 1-5; p. 377-379.

International Search Report for corresponding PCT/US2006/039884 completed Feb. 22, 2007 by Michael Unterberger of the EPO.

* cited by examiner

*Primary Examiner*—Michael C Wimer
(74) *Attorney, Agent, or Firm*—Tarolli, Sundheim Covell & Tummino LLP

(57) ABSTRACT

A three-dimensional holographic array of radio-frequency (RF) diffraction gratings, each of which has lengths of conductive and insulating fluid that are selected and adjusted to provide a desired diffraction effect on incident RF radiation. The three-dimensional array functions analogously to an optical hologram, and is programmable to provide desired refraction and focusing effects on multiple RF incident beams, which may be selectively directed to receivers or, if interferers, ignored. Because the gratings employ conductive and insulating fluids, the array can be reprogrammed in near real time to adapt to changes in the incident RF radiation.

10 Claims, 5 Drawing Sheets

RADIO FREQUENCY HOLOGRAPHIC TRANSFORMER

BACKGROUND OF THE INVENTION

This invention relates generally to radio-frequency (RF) antennas and, more particularly, to RF lens type antennas. Optical lens principles have been applied to RF antennas, either as an alternative to or in conjunction with reflective antennas. In simple terms, an RF lens comprises an array of elements that function as waveguides and provide regions of different propagation velocity for incident RF radiation. Therefore, an RF beam is refracted by the lens and can be selectively focused and/or steered as desired. RF lens type antennas have long been recognized for their advantages of high gain and very good interference rejection, but are also known to suffer from significant drawbacks. Specifically, RF lens antennas typically have a narrow instantaneous bandwidth, are limited to a handling single beam, and have a direction and frequency that are fixed by the specific hardware implementation of the lens. Unfortunately, these drawbacks are extremely significant in many fields of application, such as signals intelligence (SIGINT) and electronic warfare (EW) systems, which involve processing signals from multiple beams of different frequencies, scattered over a wide field of view and susceptible to the effects of jamming and interfering signals.

Therefore, there is a need for an RF lens type antenna that does not suffer from these drawbacks. In particular, there is a need for an RF lens type antenna that can handle multiple beams simultaneously, is not as limited in bandwidth, and can steer beams as desired, without being limited to particular hardware configurations. Ideally, it would be highly desirable to provide an RF lens type antenna that was adjustable in as near as possible to real time, to adapt rapidly to changing signal conditions. The present invention is directed to these ends.

SUMMARY OF THE INVENTION

The present invention resides in an RF lens structure that applies well known optical principles of holography and diffraction grating theory to the RF domain. Briefly, and in general terms the present invention may be defined as a three-dimensional RF holographic transformer, comprising an array of elemental RF diffraction gratings, each of which comprises selected lengths of electrically conductive material and electrically insulating material arranged in a selected alternating sequence; and means for programming each of the elemental gratings independently, to vary the lengths of conductive and insulating material contained in each of the elemental gratings in order to achieve a desired effect on one or more RF beams incident on the array of gratings. The array of gratings is programmable to perform different desired refractive operations on the incident RF beams, with each such operation being performed independently of and simultaneously with the others.

More specifically, each elemental RF diffraction grating in the three-dimensional holographic transformer comprises an elongated tube; and means for filling the tube with fluid selected from a supply of conductive fluid and a supply of insulating fluid. The means for filling the tube further comprises an electrically actuated fluid valve for selecting a supply of fluid.

In a preferred embodiment of the invention, the elemental gratings are formed across a continuous substrate ribbon, which comprises, in addition to the elongated tubes, an electrically actuated fluid valve coupled to each of the elongated tubes, a first plenum extending along the substrate ribbon to supply conductive fluid to the elongated tubes, a second plenum extending along the substrate ribbon to supply insulating fluid to the elongated tubes, a third plenum extending along the substrate ribbon to provide a discharge path for fluids removed from the elongated tubes during reprogramming of the tubes' contents, and at least one electrical conductor extending along the substrate ribbon and coupled to the electrically controlled fluid valves to provide controlled selection of fluid for each elongated tube either from the first plenum, the second plenum, or a blend of the first and second plenums. In this embodiment, the substrate ribbon is rolled to form a three-dimensional bundle of the elemental gratings, although other possible structures can be envisioned in which the elemental gratings are arrayed in a different manner.

More specifically, each elemental grating comprises, in addition to the elongated tube, a feed tube supplied from a selected fluid through its fluid valve. The feed tube is smaller in cross section than the elongated tube, and extends though the elongated tube through substantially all of its length. The feed tube is open at its distal end and the elongated tube is closed at its distal end. The elemental grating is programmed by drawing selected amounts of conducting and insulating fluid through the feed tube and into the elongated tube, such that the latter becomes filled with selected lengths of conductive fluid, insulating fluid and, if selected, blended proportions of both conductive and insulating fluids.

The invention may also be defined in terms of a method for processing radio-frequency (RF) beams in a three-dimensional holographic transformer having an array of independently programmable RF grating elements. Briefly, the method comprises the steps of determining by computation the grating configuration needed to effect a transformation of each of one or more RF signals incident on the array; configuring each elemental grating in an array of such gratings, to comprise selected lengths of conductive and insulating fluids, as arrived at in the determining step; and adjusting and reconfiguring each elemental grating as necessary to adapt to changing configurations of incident RF signals.

More specifically, in accordance with this method the step of configuring each elemental grating comprises selecting fluid from a supply of conductive fluid, a supply of insulating fluid, or a combination of the two supplies; pumping selected fluid supplies into an elongated tube, to form therein layers of conductive fluid, insulating fluid and, if selected, a blend of conductive and insulating fluids; and simultaneously with the pumping step, discharging unwanted fluid from the elongated tube.

It will be appreciated from the foregoing that the present invention represents a significant advance in RF lens type antennas. In particular, the invention provides an RF hologram that can be rapidly and conveniently programmed to perform a desired refraction effect on multiple incident RF beams, which may emanate from different directions and have different frequency bandwidths. Other aspects and advantages of the invention will become apparent from the following more detailed description, taken in conjunction with the accompanying drawings.

DETAILED DESCRIPTION OF THE INVENTION

Figure 1:
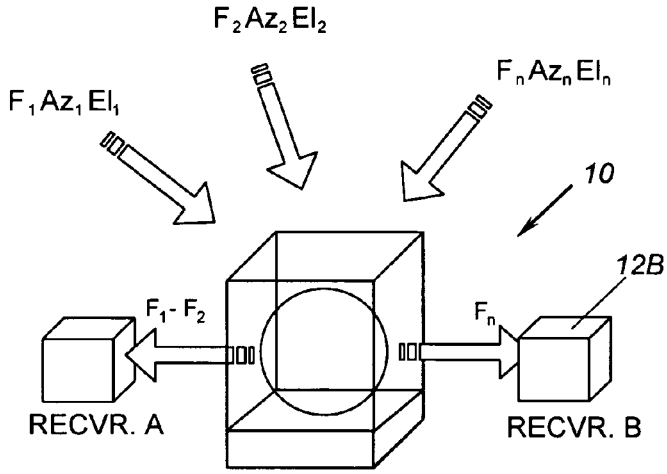
FIG. 1 is diagrammatic view depicting the general functions performed by a three-dimensional holographic transformer in accordance with the present invention.

As shown in the drawings for purposes of illustration, the present invention pertains to the application of holography and diffraction grating principles to radio-frequency (RF) lens type antennas. Basically, an RF lens comprises an array of elements that have the effect of refracting an RF beam, in a manner analogous to the refraction of optical radiation by an optical lens. Although RF lens type antennas have been known for some years, their use in practice has been limited by their known disadvantages of a narrow instantaneous bandwidth, and frequency and directional characteristics that are fixed by the specifics of hardware implementation.

In accordance with the invention, optical principles of holography and diffractions gratings are applied in the context of RF radiation. As will become apparent from the following description, a holographic device applying the principles of the invention can be conveniently configured to handle multiple RF beams, to null out interfering RF sources, and to provide excellent linearity and high dynamic range of operation.

FIG. 1 depicts the invention in diagrammatic form. A three-dimensional holographic transformer is indicated by a cube shape and reference numeral 10. By way of example, three RF beams are shown as being received by the transformer 10: A first signal of interest $F_1$ received from an azimuth $Az_1$ and an elevation $El_1$, an interferer $F_2$ received from an azimuth $Az_2$ and an elevation $El_2$, and another signal of interest $F_n$ received from an azimuth $Az_n$ and an elevation $El_n$. Also depicted in FIG. 1 are two receivers 12A and 12B to which the signals of interest are to be directed. Ideally, the holographic transformer 10 should be capable of performing the functions of: (1) beam pointing in azimuth and elevation, simultaneously for the multiple received beams, (2) beam shaping for a specified center frequency and bandwidth, (3) cancellation of undesirable interference by superimposing nulls for the interfering sources, (4) focusing transformed received beams to one or more of the receivers 12A and 12B, and (5) performing these functions passively to provide a wide bandwidth, such as 20 GHz, and a wide dynamic range, such as 120 dB, with minimal insertion losses.

Holograms have been generated for decades by photographic processes in which an optically coherent reference is interfered with its own reflection from an object, onto a photographically sensitive plate or volume emulsion. The result is a hologram that, when illuminated by the same reference, creates a virtual image that is equivalent to the original object, including perspective change. Changing the position of the real image or the reference will result in different holograms and, therefore, new and different virtual images. The present invention generates a synthesis of three-dimensional holographic solutions in a computer, thereby removing the need for a reference, since it is common to the coordinate system of each three-dimensional matrix solution. Additionally, the ability to process multiple beams, multiple frequencies, and multiple focusing solutions requires that the holograms be constructed with diffractive media that retain amplitude control over the transfer functions, since the entire vector expression includes coefficients and cannot be accomplished successfully with laminations of binary phase planes.

Figure 2:
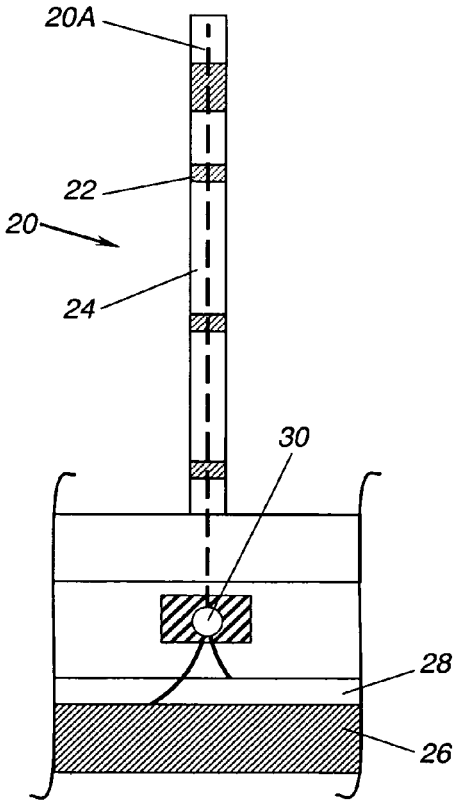
FIG. 2 is a diagrammatic view of an elemental RF grating in accordance with the invention.
Figure 2A:
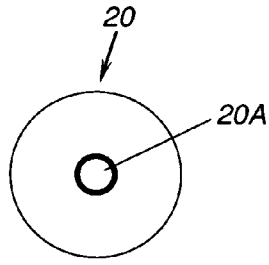
FIG. 2A is an enlarged cross-sectional view the elemental grating of FIG. 2.

An elemental grating in a three-dimensional volume hologram is shown diagrammatically in FIG. 2, in which the grating element is indicated at 20. The element 20 is a rod-shaped grating construction channel, which is "programmed" or constructed to comprise alternating regions of electrically conductive fluid, indicated at 22, and electrically insulating fluid, indicated at 24, of selected lengths. During programming of a grating element 20, conductive fluid is drawn up through a central feed tube 20A in the element, from a supply of conductive fluid 26, and insulating fluid is drawn up through the same tube from a supply of insulator fluid 28. Selection of either the conductive fluid 26 or the insulator fluid 28, or a blend of both, is controlled by a fluid switch 30, which may, for example be a piezoelectric switch. The selected fluid volumes are drawn up the central feed tube 20A and then flow back down the construction channel around the outside of the feed tube. The feed tube 20A is open at its top but the outer grating construction channel 20 is closed at the top. Programming of the grating element 20 is complete when the desired pattern of conductive and insulator fluids is present in the grating element. Whenever the grating element 20 is programmed in this manner, fluid layers previously present in the element are ejected into a discharge plenum 32.

Figure 3A:
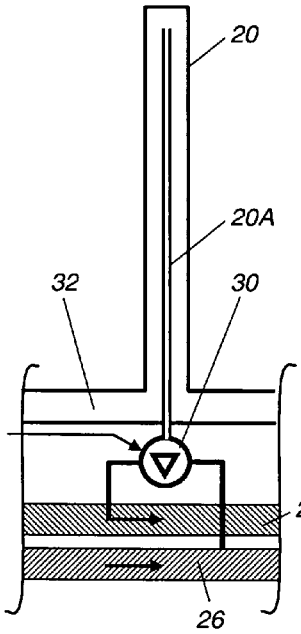
FIGS. 3A, 3B and 3C are additional views of the elemental grating of FIG. 2, showing the grating in an off configuration, a conductor fluid selection configuration and an insulating fluid selection configuration, respectively.
Figure 3B:
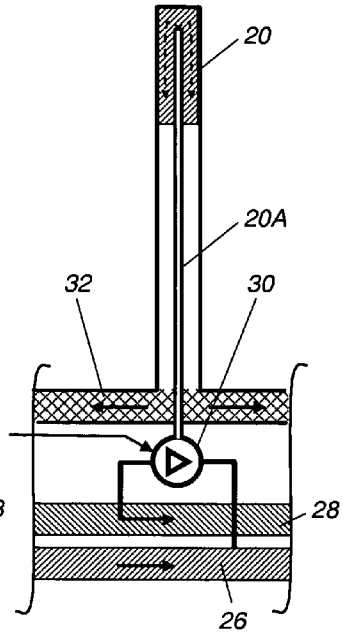
Figure 3C:
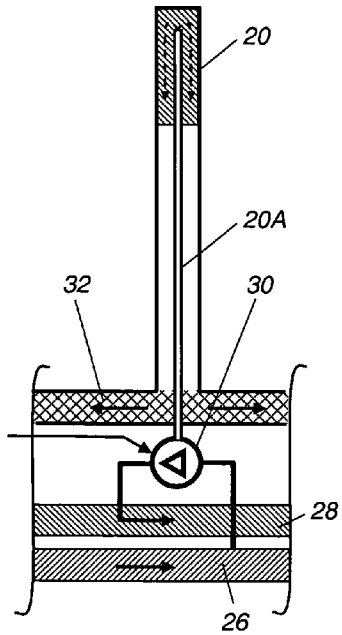

Programming of a single grating element 20 is further depicted in FIGS. 3A-3C, from which it will be apparent that the central feed tube 20A is of a relatively small diameter and operates at a relatively high flow rate to provide grating solutions to the top of the tube. If desired, the tube 20A may be connectable to a "benign" liquid supply (not shown) containing a dielectric, or may be totally filled with the insulator fluid 28 to return the grating element 20 to a benign starting configuration. FIG. 3A depicts an empty grating element 20, with the switch 30 in an 'off' position, not connected to either the conductor fluid plenum 26 or the insulator fluid plenum 28. FIG. 3B shows the grating element 20 with its switch 30 in the 'conductor' position, which connects the feed tube 20A with the conductor fluid plenum 26. FIG. 3C shows the grating element 20 with its switch 30 in the 'insulator' position, which connects the feed tube 20A with the insulator fluid plenum 28.

Figure 4:
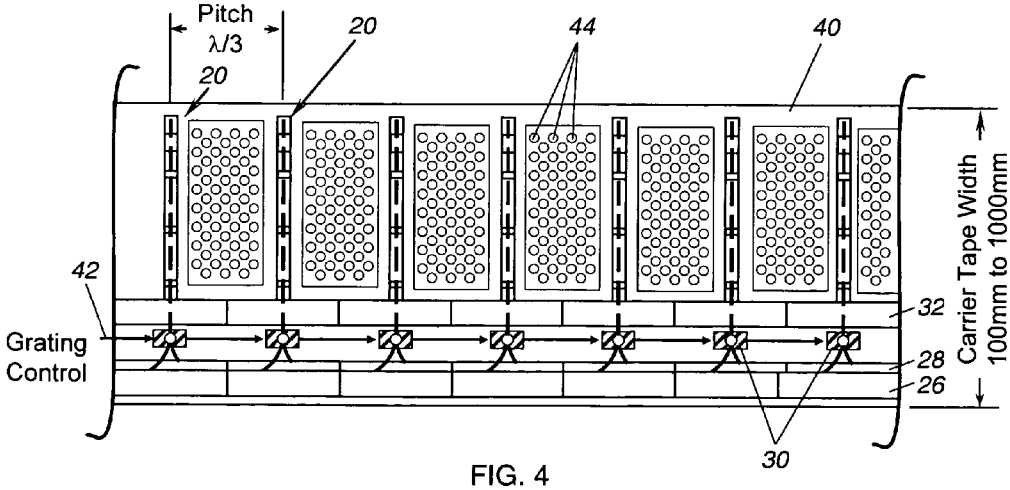
FIG. 4 depicts a continuous tape assembly of multiple gratings of the type shown in FIG. 2.
Figure 5:
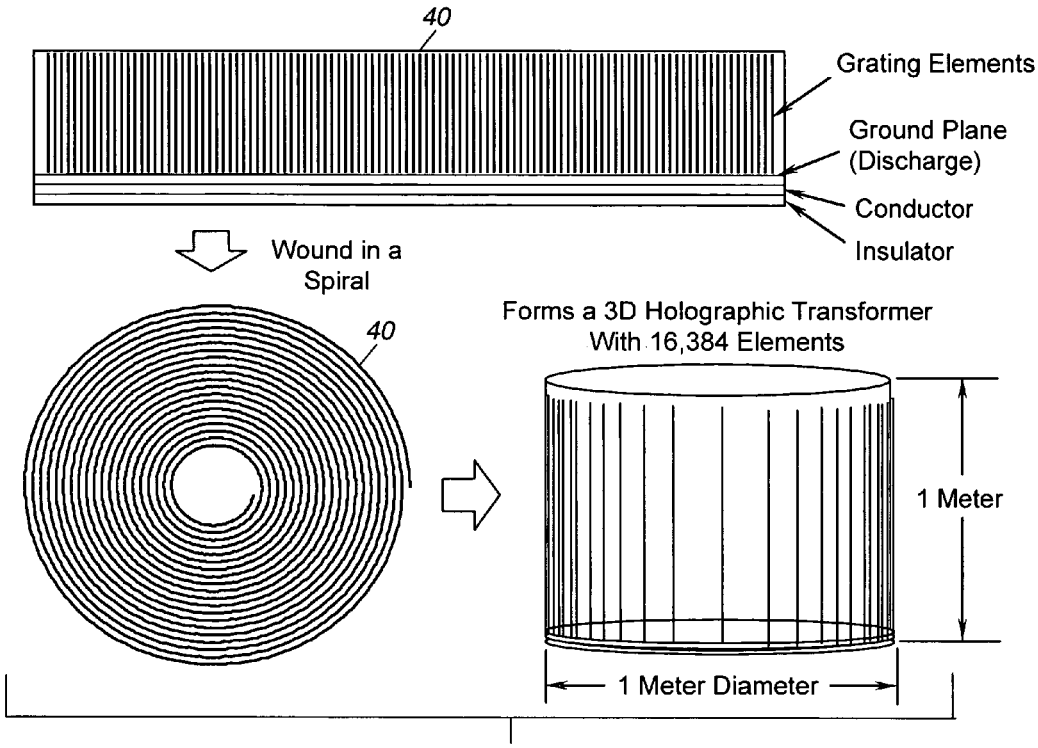
FIG. 5 depicts how the tape assembly of FIG. 4 is rolled into a cylindrical shape to form the three-dimensional holographic transformer of the invention.

The grating construction of the invention is well suited to facilitate manufacturing, for reasons that become apparent from consideration of FIGS. 4 and 5. First, a volume hologram comprising multiple grating elements 20 can be produced with multiple printed circuit laminations, where each lamination is cut and/or thermally stamped with the required patterns and cavities controlled by computer aided design and manufacturing (CADAM) techniques. Second, an array of gratings is inherently adaptive, which can create a calibration equalizer matrix that is applied to each volume hologram solution computed thereafter over time and temperature changes. Errors in grating spacing may be induced by environmental changes, such as temperature or materials aging, as well as by inaccuracies in the manufacturing process. Compensation for such errors can be easily superimposed onto the generated grating dimensions in order to achieve optimal performance and stability. A third advantage of the invention is that the array is inherently its own test set, since a pilot tone can be generated and then adaptively tuned. Reference drive or pilot tones are useful as a training signal for correlative recognition algorithms. Recognition of a desired signal can be achieved by adapting the volume gratings to a transformer maximum power output while being irradiated with a synthesized version of that desired signal or reference waveform prior to online operation. This is easily performed with closed loop adaptation and is called training. Conversely, if the inversion of the reference is used as the training signal, then nullification of an undesired signal, such as an interferer, may be achieved.

FIG. 4 depicts a linear array of grating elements 20 embedded in a polyvinyl substrate carrier 40 in the form of a continuous tape. The structure also includes embedded switches 30 for grating control, embedded plenums 26, 28 and 32 for conductor fluid, insulator fluid and discharge, respectively, and embedded cavities for the supply lines connecting the two supply plenums to the switches 30. Also embedded in the substrate carrier 40 is a grating control signal and control feedback line 42, chained between the switches 30 to carry control signals that are uniquely recognizable by the switches, and to carry status information back to a controller (not shown). The Tape assembly also contains a power distribution line and a ground plane. The substrate carrier 40 may be perforated with multiple openings 44 to reduce the total mass of the structure. In the illustrative embodiment of the invention, the tape assembly of gratings depicted in FIG. 4 may be of any desired width, such as 100 mm to 1000 mm.

FIG. 5 shows how the linear array of FIG. 4 may be configured to form a three-dimensional array of grating elements. In this embodiment of the invention, a holographic transformer is formed by winding the tape assembly of FIG. 4 into a cylindrical form. The tape assembly is wound onto itself repeatedly until a cylinder of approximately one meter diameter is formed, as shown in FIG. 5.

Figure 6:
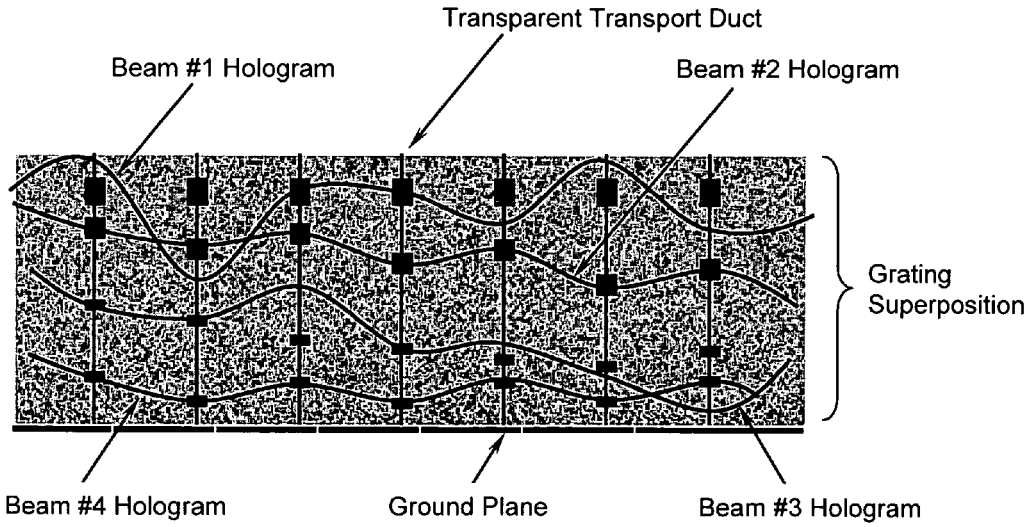
FIG. 6 is a diagrammatic representation of four independent holograms recorded in the three dimensional holographic transformer of the invention.

FIG. 6 diagrammatically illustrates four holograms superposed in a holographic transformer in accordance with the invention. Each of the four holograms in general has a unique frequency band, azimuth, elevation and beam shape, and each of the separated beam solutions is shown as a set of diffractive functions achieved in a single volume. In effect, the four curves define the equivalent reflector that would result from the unrecognizable three-dimensional grating. They are shown superimposed in a single view in an attempt to depict a translation from Fourier space into reflector surfaces. The horizontal axis in FIG. 6 is the length dimension of the tape assembly when in an unrolled condition. The vertical axis is distance along the height or width of the tape assembly.

The vertical lines in FIG. 6 represent transparent transport ducts that are used to form the individual grating elements 20, and the small rectangles located on the transport ducts diagrammatically represent conductive nodes positioned to perform the diffraction grating effect. The overall confetti-like appearance of the FIG. 6 representation is intended to depict what the three-dimensional diffraction volume would look like if it was injected with gratings everywhere along the tape length, as viewed from the side of three-dimensional tape assembly. Thus, FIG. 6 depicts two aspects of the tape assembly. First it depicts by way of example four reflector characteristics as viewed for a portion of the unrolled tape assembly, and second it depicts the nature of a typical three-dimensional diffraction volume.

Figure 7:
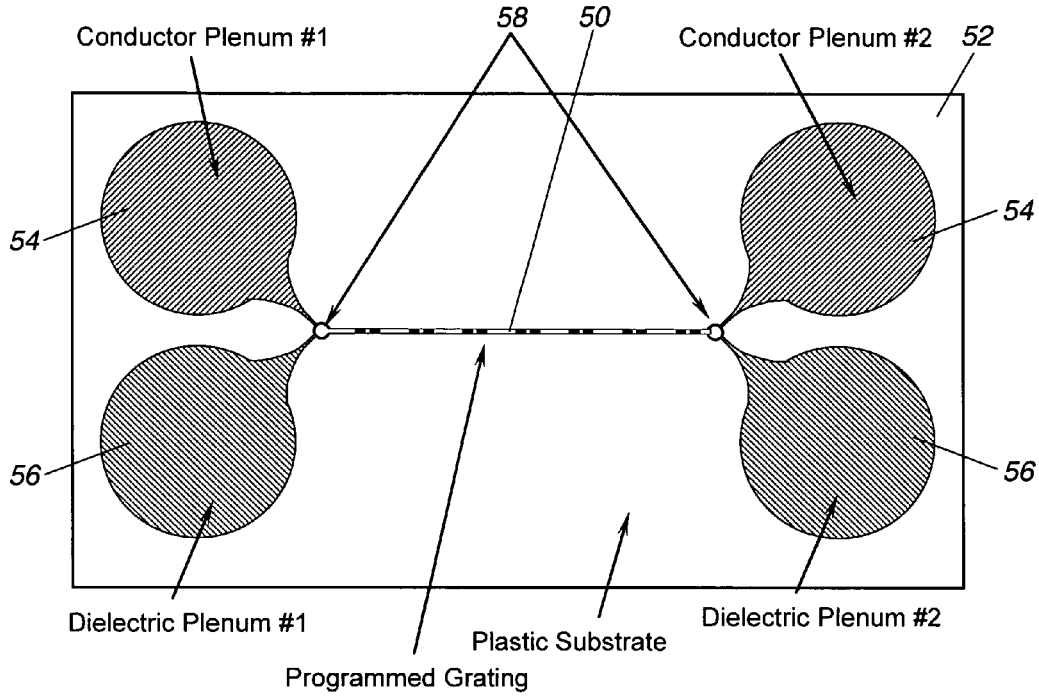
FIG. 7 a diagrammatic view of a single grating for use in a test bed.
Figure 8:
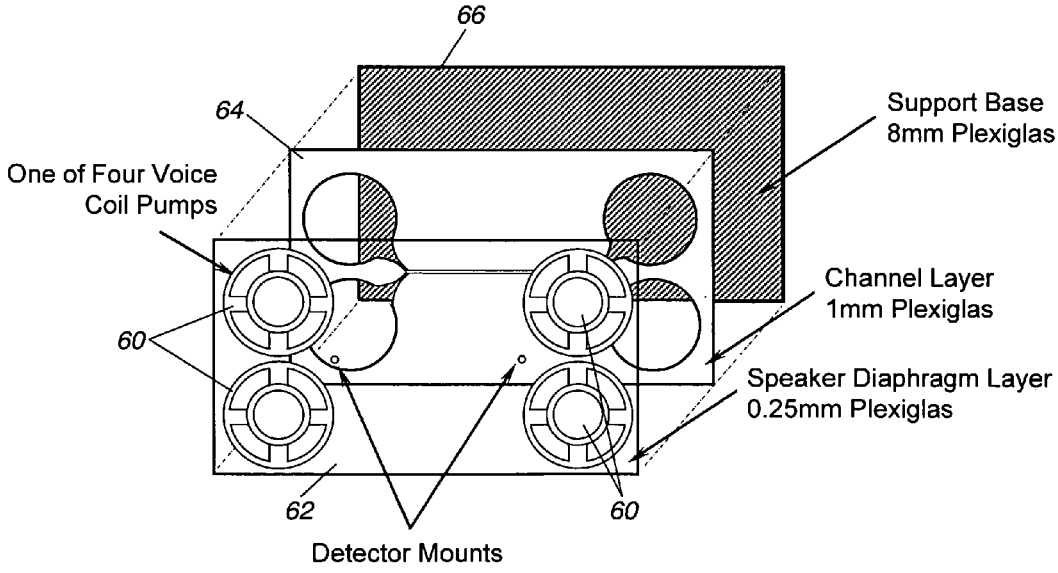
FIG. 8 is an exploded view of a unit assembly of a single grating of the type shown in FIG. 7.

The principles of operation of the three-dimensional fluidic grating described above can be verified in a test bed having a single programmed grating element, as shown in FIGS. 7 and 8. a grating element 50 is formed on a plastic substrate 52 as an elongated tube. Each end of the tube is connectable to one of two conductor liquid plenums 54 and to one of two dielectric liquid plenums 56. Each end of the tube 50 has an installed fluid type detector 58 to determine the type of fluid entering or leaving the tube. As best shown in FIG. 8, a voice coil pump 60 is installed over each plenum to force fluid into the grating 50 under computer control. The structure may be conveniently constructed as three plastic sheets 62, 64 and 66, as shown in FIG. 8. The top layer 62 is a thin, transparent cover sheet, for example 0.25 mm in thickness. The middle sheet 64 may be, for example, 1 mm thick and has the plenums 54 and 56 and the tube 50 formed in it by processing on a conventional laser cutting table. The third layer 66 is a transparent support base of suitable thickness, such as 8 mm, to provide rigid support for the entire assembly.

Figure 9:
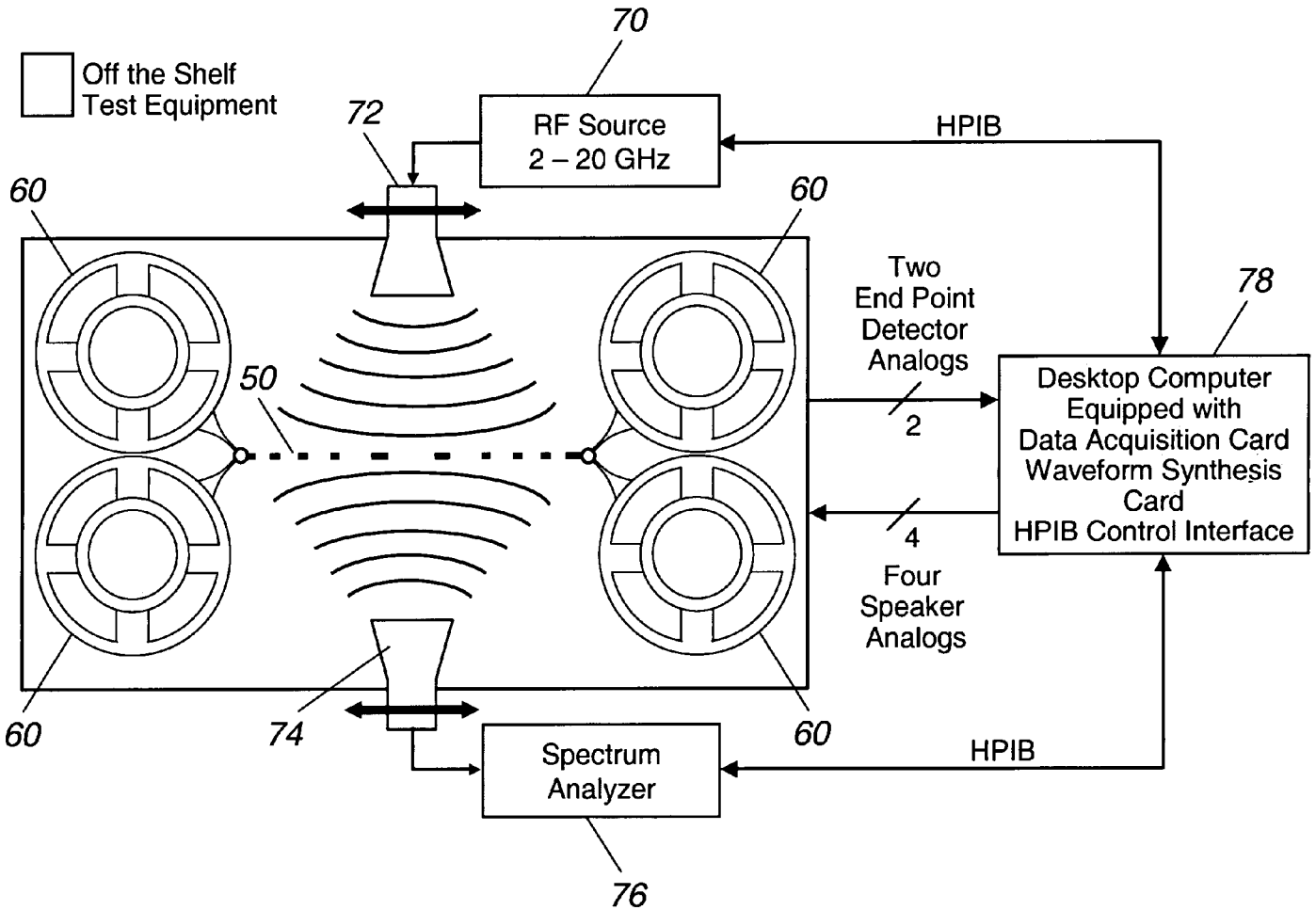
FIG. 9 is a schematic diagram of a test bed for evaluating the performance characteristics of a single grating of the type shown in FIGS. 7 and 8.

As shown in FIG. 9 the grating unit assembly of FIG. 8 may be usefully tested by directing signals toward the grating element 50 from an RF source 70 and associated transmitting antenna 72, and receiving signals received on the opposite side of the grating element, at a receiving antenna 74 and spectrum analyzer 76. A conventional digital computer 78 controls the RF source 70 and the spectrum analyzer 76, and receives data from the spectrum analyzer. The computer 78 also generates four analog signals to activate the four voice coil pumps 60, and receives two analog signals from the fluid type detectors 58 at the ends of the grating tube 50. The computer 78 can be a conventional desktop computer equipped with a data acquisition card, a waveform synthesis card and a suitable control interface, such as an IEEE-488 interface bus (or HP-IB), for connecting to the RF source 70 and the spectrum analyzer 76. Performance criteria of the single grating element 50 can be completely characterized using this arrangement, by varying the grating physical characteristics and measuring the effect of the grating on RF beams of various frequencies and angles of incidence. Performance characteristics of the single grating element 50 can then be used to predict the performance of the three-dimensional hologram described above and to determine the grating parameters of each grating element needed to achieve a desired effect in the three-dimensional hologram.

It will be appreciated from the foregoing that the present invention represents a significant advance in the field of RF lens type antennas. In particular, the invention provides a three-dimensional holographic transformer that can be programmed to refract multiple received RF beams toward desired receiver locations, even when the multiple received beams are at different frequencies and are incident from different angles of azimuth and elevation. It will also be appreciated that, although a specific embodiment of the invention has been illustrated and described in detail, various modifications may be made without departing from the spirit and scope of the invention. Accordingly, the invention should not be limited except as by the appended claims.

The invention claimed is:

1. A three-dimensional radio-frequency (RF) holographic transformer, comprising:

an array of elemental RF diffraction gratings, each of which comprises selected lengths of electrically conductive material and electrically insulating material arranged in a selected alternating sequence; and means for programming each of the elemental gratings independently, to vary the lengths of conductive and insulating material contained in each of the elemental gratings in order to achieve a desired effect on one or more RF beams incident on the away of gratings;

wherein the array of gratings is programmable to perform different desired refractive operations on the incident RF beams, each such operation being performed independently of and simultaneously with the others.

2. A three-dimensional RF holographic transformer as defined in claim 1, wherein each elemental RF diffraction grating comprises: an elongated tube; and means for filling the tube with fluid selected from a supply of conductive fluid and a supply of insulating fluid.

3. A three-dimensional RF holographic transformer as defined in claim 2, wherein the means for filling the tube further comprises an electrically actuated fluid valve for selecting a supply of fluid.

4. A three-dimensional RF holographic transformer as defined in claim 2, wherein:

the elemental gratings are formed on a continuous substrate ribbon, which comprises, in addition to the elongated tubes, an electrically actuated fluid valve coupled to each of the elongated tubes, a first plenum extending along the substrate ribbon to supply conductive fluid to the elongated tubes, a second plenum extending along the substrate ribbon to supply insulating fluid to the elongated tubes, a third plenum extending along the substrate ribbon to provide a discharge path for fluids removed from the elongated tubes during reprogramming of the tubes' contents, and at least one electrical conductor extending along the substrate ribbon and coupled to electrically controlled fluid valves to provide controlled selection of fluid for each elongated tube either from the first plenum, the second plenum, or a blend of the first and second plenums; and the substrate ribbon is rolled to form a three-dimensional bundle of the elemental gratings.

5. A three-dimensional RF holographic transformer as defined in claim 4, wherein each elemental grating comprises, in addition to the elongated tube: a feed tube supplied from a selected fluid through its fluid valve, wherein the feed tube is smaller in cross section than the elongated tube, and extends though the elongated tube through substantially all of its length;

wherein the feed tube is open at its distal end and the elongated tube is closed at its distal end, and wherein the elemental grating is programmed by drawing selected amounts of conducting and insulating fluid through the feed tube and into the elongated tube, such that the latter becomes filled with selected lengths of conductive fluid, insulating fluid and, if selected, blended proportions of both conductive and insulating fluids.

6. A method for processing radio-frequency (RF) beams in a three-dimensional holographic transformer having an array of independently programmable RF grating elements, the method comprising:

determining by computation the grating configuration needed to effect a transformation of each of one or more RF signals incident on the array;

configuring each elemental grating in an array of such gratings, to comprise selected lengths of conductive and insulating fluids, as arrived at in the determining step; and adjusting and reconfiguring each elemental grating as necessary to adapt to changing configurations of incident RF signals.

7. A method as define by claim 6, wherein the step of configuring each elemental grating comprises: selecting fluid from a supply of conductive fluid, a supply of insulating fluid, or a combination of the two supplies;

pumping selected fluid supplies into an elongated tube, to form therein layers of conductive fluid, insulating fluid and, if selected, a blend of conductive and insulating fluids; and simultaneously with the pumping step, discharging unwanted fluid from the elongated tube.

8. A three-dimensional radio-frequency (RF) holographic transformer, comprising:

an array of elemental RF diffraction gratings, each of which comprises selected lengths of electrically conductive material and electrically insulating material arranged in a selected alternating sequence; and an array of electronically controllable switches configured to vary the lengths of electrically conductive material and electrically insulating material contained in each of the elemental RF diffraction gratings in order to achieve a desired diffraction on one or more RF beams incident on the array of elemental RF diffraction gratings.

9. The three-dimensional RF holographic transformer of claim 8, wherein:

each elemental RF diffraction grating of the array of elemental RF diffraction gratings comprises an elongated tube; and the electrically conductive material comprises an electrically conductive fluid and the electrically insulating material comprises an electrically insulating fluid.

10. The three-dimensional RF holographic transformer of claim 8, wherein the selected alternating sequence of at least one of the elemental RF diffraction gratings of the array of elemental RF diffraction gratings includes at least three selected lengths.

* * * * *